United States Patent [19]

Masuda et al.

[11] Patent Number: 4,552,599

[45] Date of Patent: Nov. 12, 1985

[54] PROCESS FOR PRODUCING INSULATED RECTANGULAR WIRE

[75] Inventors: Shigeo Masuda; Morihiko Katsuda, both of Aichi, Japan

[73] Assignee: Sumitomo Electric Industries, Ltd., Japan

[21] Appl. No.: 608,287

[22] Filed: May 8, 1984

[30] Foreign Application Priority Data

May 11, 1983 [JP] Japan ..... 58-82206

[51] Int. Cl.[4] ..... H01B 13/06

[52] U.S. Cl. ..... 156/50; 29/825; 72/46; 72/206; 72/278; 156/51

[58] Field of Search ..... 29/825; 156/50, 52, 156/55, 56, 51; 72/46, 206, 278; 174/117 FF, 119 C, 119 R, 133 R

[56] References Cited

U.S. PATENT DOCUMENTS

| | | | |
|---|---|---|---|
| 3,779,055 | 12/1973 | Goyffon | 72/46 |
| 3,811,311 | 5/1974 | Barone et al. | 72/278 |
| 3,874,076 | 4/1975 | Tsukamoto et al. | 156/50 X |
| 3,976,815 | 8/1976 | Brekle | 72/46 X |
| 4,386,513 | 6/1983 | Doudet | 72/278 X |
| 4,439,256 | 3/1984 | Meserve | 156/50 |
| 4,473,716 | 9/1984 | Jesseman | 156/50 X |
| 4,476,192 | 10/1984 | Imai et al. | 428/391 |

*Primary Examiner*—Robert A. Dawson

*Attorney, Agent, or Firm*—Sughrue, Mion, Zinn, Macpeak, and Seas

[57] ABSTRACT

A process for producing an insulated rectangular wire adapted for edgewise winding. A round wire of copper, copper alloy, aluminum or aluminum alloy is drawn through a die in a tandem-extrusion apparatus. The drawn wire is then electrolytically cleaned, following which an insulating coating is applied to the cleaned surface. The insulating coating is baked, and finally the insulated wire is subjected to at least one cycle of rolling. Preferably, the drawing is done with a single die and capstan to thereby remove any surface defects in the conductor having a size of 3 μm or greater. The capstan should be made of a material softer than the material of the conductor. Further, it is preferred that fresh lubricating oil containing no metal dust be applied to the surface of the conductor during the drawing process.

3 Claims, 1 Drawing Figure

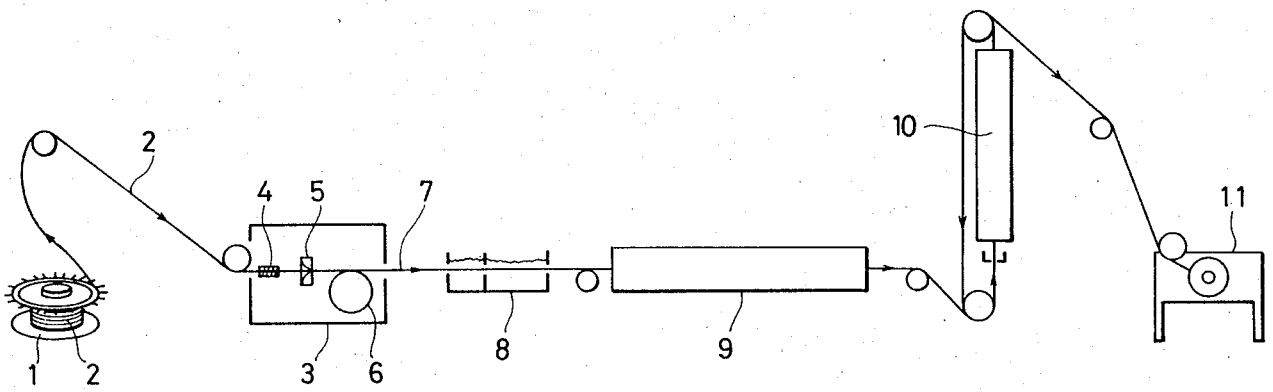
1
2
2
3
4
5
6
7
8
9
10
11

PROCESS FOR PRODUCING INSULATED RECTANGULAR WIRE

BACKGROUND OF THE INVENTION

The present invention relates to a process for producing an insulated rectangular (flat) wire by applying an insulating material onto a round conductor, baking the insulating coating, and rolling the insulated wire into a rectangular or flat shape. The present invention relates particularly to a process for producing an insulated rectangular wire having excellent insulating properties that adapt the wire to edgewise winding.

Rectangular insulated wire manufactured by drawing round insulated wire has been extensively used for voice coils of loudspeakers. The range of application of such wire has recently been expanded to include drive motors for computer-associated equipment. Insulated rectangular wires may be wound into a coil flatwise, but more frequently, they are wound edgewise. Rectangular insulated wires for use in coils must meet the following requirements: (1) Each turn of the coil has a smooth and even surface. This requirement imposes a maximum limit of the amount of variation in the width of the flat insulated wire. (2) The insulating coating is crack free and has no part where the conductor is exposed. This means that there should be no breakage of the insulating coating when pressure is applied in the rolling operation, and that surface flaws in the conductor should not cause cracks in the insulating coating due to mechanical stress occurring during the winding of the insulated wire into a coil. (3) The insulating coating adheres sufficiently strongly to the conductor that no separation of the coating occurs while the round insulated wire is shaped into a rectangular form under a very high pressure.

The present inventors previously filed a patent application for a process for producing a rectangular insulated wire having a very high precision in the dimension of width by applying a coating of an insulating material onto a rigid conductor and baking the insulating coating. However, no satisfactory solutions have been proposed for meeting requirements (2) and (3). That is, if a round conductor has a surface flaw, the insulating coating over that flaw may crack during the process of rolling the round wire into a flat shape. Even a very small flaw in the conductor surface can cause such a defect when the rectangular insulated wire is wound into a coil edgewise. That is, the surface area of each turn of the coil facing the outside is expanded during winding so that the insulating coating tends to crack. On the other hand, the surfaces facing the center of the coil shrink in area as the coil is wound, and hence the possibility of cracking the coating is much smaller than in the coating facing outward. Cracks in the insulating coating unavoidably deteriorate the electrical properties of the coil and impair its reliability and service life by an appreciable degree. Therefore, an improved method for producing a rectangular insulated wire having no cracks in the insulating coating has long been desired.

In order to produce a flat insulated wire having a higher width to thickness ratio, the round wire must be rolled at an increased reduction ratio, but then the strength of adhesion of the insulating coating to the underlying conductor is decreased so as to increase the possibility of separation of the insulating coating from the conductor. If the width to thickness ratio of the wire exceeds about five, the round wire must be subjected to at least two roll passes. Doing so, however, further weakens the adhesion of the insulating coating to the conductor and increases the chance of separation of the insulating coating.

In order to solve these problems, the present inventors have made various studies on a process for producing a rectangular insulated wire by rolling a round wire without causing cracks or separation of the insulating coating from the conductor.

SUMMARY OF THE INVENTION

Accordingly, an object of the present invention is to provide a process for producing a rectangular insulated wire of good quality by applying an insulating coating to a round conductor that has been free of surface flaws and deposits, baking the insulating coating, and rolling the round insulated wire into a rectangular shape.

More specifically, the process used a tandem-drawing zone, an electrolytic cleaning apparatus, a coating applicator and a baking chamber. By passing a round conductor through the drawing zone, the conductor is not only reduced in diameter but also free of surface defects such as checks, laps, slivers, cracks and streaks. The drawn conductor is then passed into the electrolytic cleaning section where the wire is cleaned of oil or metal dust that has built up during the drawing operation. Subsequently, the conductor is fed into the applicator zone where the insulating coating is applied to the conductor, and the wire is then passed through the baking chamber. The resulting round insulated wire is then given at least one roll pass, thereby forming a rectangular insulated wire.

The round insulated wire obtained as an intermediate product will cause no cracking in the insulating coating during the subsequent rolling. The final rectangular wire will also cause no cracking even when it is wound into a coil edgewise, and hence is free from the problem of exposing the conductor. As a further advantage, by removing all foreign material such as oil and metal dust from the conductor surface in the electrolytic cleaning step, a rectangular insulated wire having no possibility of separation of the insulating coating from the conductor is provided.

BRIEF DESCRIPTION OF THE DRAWING

The single drawing FIGURE is a schematic diagram illustrating a process for producing a round insulated wire from which a rectangular insulated wire according to the present invention is manufactured.

DESCRIPTION OF THE PREFERRED EMBODIMENT

In the processing line shown in the drawing, a round conductor 2 on a supply reel 1 is unwound and fed into a tandem-drawing zone 3. The surface of this conductor has many microscopic flaws that have been introduced in the predrawing steps due either to slippage on the capstan surface or to contact with the barrel or flanges of take-up reels. Upon close analysis, most of these flaws have depths and widths ranging from 3 to 20 $\mu$m, and lengths ranging from as small as 2 $\mu$m to as large as several meters.

The present inventors have examined the relationship between the size of the conductor surface flaws and the possibility of cracking that occurs in the insulating coating during rolling and found that surface flaws having a depth and width of 3 μm or more increase the chance of subsequent cracking in the insulating coating. With this in mind, the present inventors have made intensive efforts to eliminate surface flaws whose depth and width were 3 μm or larger. Some conductors have surface flaws that exceed 20 μm in deptn and width, but such flaws can be avoided by better workmanship in the predrawing steps.

In order to eliminate the formation of surface flaws whose depth and width are in the range of 3 to 20 μm, the present invention uses a tandem-drawing machine 3 which has a single die 5 through which the round conductor is passed once. The wire is subsequently forwarded to the next stage by means of a capstan 6. When the wire, which has an initial diameter of $D_1$, is drawn down to a size of $D_2$ by being passed through the single die, the reduction ratio is given by:

$$(D_1^2 - D_2^2)/D_1^2 \times 100.$$

Elimination of surface flaws ranging in size from 3 to 20 μm requires careful control over the reduction ratio. For example, if one wants to draw three copper wires (0.60 mm$^{\Phi}$) having surface flaws in the conductor of depths of 5, 10 and 20 μm, respectively, and obtain products where the maximum flaw size is less than 3 μm, it is necessary to perform a single drawing operation to provide wire diameters of about 0.585, 0.560 and 0.550 mm. These correspond to reduction ratio of 5, 13 and 16%. A higher reduction ratio is effective in removing larger flaws. However, for the process of the present invention (which features a single drawing operation) a reduction ratio higher than 25% should be avoided because this requires an excessively great drawdown force, which increases the chance of formation of further surface flaws in the conductor as it is guided in contact with the capstan.

The present invention uses only one drawing die 5 in order to avoid slippage of the conductor 2 with respect to the capstan 6 which may result in the formation of further surface flaws on the conductor. If two or more dies are used, a capstan is necessary between each die; however, it is very difficult to otain complete agreement between the peripheral speed of the capstan and the linear speed of the conductor, the latter being determined by the diameter of the die orifice. If there is a difference between the linear speed of the conductor and the peripheral speed of the capstan, the conductor will slip on the capstan surface, which may cause further flaws to develope in the conductor surface. Therefore, the process of the present invention uses a single die for drawing the conductor.

Another feature of the drawing operation effected in the present invention is that a lubricant oil containing no metal dust is applied to the conductor. This is accomplished by providing a lubricating oil applicator 4 upstream of the die 5 with which clean lubricating oil free of metal dust is supplied to the conductor 2, thereby ensuring smooth passage of the conductor through the die. If recycled lubricating oil that contains the metal particles produced during the drawing operation is used the particles build up in the oil and may cause damage the surface of the conductor being drawn through the die. In order to prevent this, the conductor must be continuously supplied with clean lubricating oil containing no metal dust.

The material of the capstan 6 for guiding the conductor 7 coming out of the die is another important feature of the present invention. A particularly important point here is the hardness of the part of the capstan which contacts the running conductor. If that part of the capstan is made of a material harder than the conductor, the force acting between the two members, coupled with the hardness and surface roughness of the capstan, may cause development of further microscopic flaws on the conductor surface depending upon the amount and size of metal particles that build up on the conductor. According to experiments conducted by the present inventors, this problem can be avoided by using a capstan which is made of a material softer than the conductor.

Any practical material that is softer than the conductor to be drawn may be used for the capstan 6. Suitable examples include general and engineering plastics such as styrene resins, polyvinyl chloride, polyethylene, polypropylene, nylon 6, nylon 66, nylon 12, polyacetal, polycarbonate, polysulfone, phenoxy resins, phenolic resins, melamine resins, silicone resins, urethane resins, epoxy resins, polyester resins, urea resins and fluorine resins, as well as mixture or composites of these plastics. They may be filled with suitable additives. Other suitable capstan materials are synthetic rubbers such as silicone rubber, fluorine rubber, urethane rubber, acrylic rubber, polybutadiene, butadiene-styrene rubber, polychloroprene, polyisobutylene, and isobutylene-isoprene rubber.

These plastics and rubbers may be directly processed into the desired shape of the capstan. Alternatively, they may be used as the lining of the surface of a capstan made of another material so as to protect the area which contacts the drawn conductor. The capstan may be made of any metal that is softer than the conductor. Needless to say, the surface of the capstan wears over time and must be renewed when a certain amount of wear has occurred.

Yet another important requirement of the present invention is that the surface of the conductor be kept clean. The conductor 7 emerging from the die 5 always carries on its surface a film of lubricating oil used in the drawing operation, and in addition, metal particles produced during the drawing step also build up on the conductor surface. Such as deposit of metal dust or lubricating oil may be reduced to some extent by eliminating flaws on the conductor surface, but this alone is not sufficient to eliminate such deposits completely. If an insulating coating is applied to a conductor surface which is not entirely free of metal dust or lubricating oil film, when the resulting insulating coating is baked, the coating will not adhere sufficiently strongly to the conductor and may separate therefrom during the subsequent rolling procedure.

In order to eliminate all deposits of metal dust and lubricating oil from the conductor surface, the present inventors have tried various methods of cleaning the conductor, and have found that electrolytic cleaning is the simplest and most effective method. Organic solvents, ultrasonic waves, alkalis or acids used independently or in combination proved less efficient than electrolytic means in cleaning the surface of the conductor. By applying electrolytic cleaning, the conductor surface can be completely cleaned of any deposit of lubricating oil and metal particles, and as a result, the adhesion of the insulating coating to the conductor is increased to such a level that very few areas occur where the insulating coating separates from the conductor, even if the round insulated wire is subjected to more than one roll passes. For the purpose of the present invention, the minimum current density at the conductor surface is 5 mA/mm$^2$. Needless to say, the proper current density can be set at a value to suit the desired degree of cleaning.

After electrolytic cleaning, excess electrolyte on the conductor surface is washed away with warm water, and the conductor is subjected to the application and baking of an insulating coating. The so-prepared round insulated wire can be rolled into a rectangular shape without causing cracking in or separation of the insulating coating. Furthermore, the completed rectangular insulated wire can be wound into a coil edgewise without causing separation of the insulating coating from the conductor.

The process of the present invention is effective not only for producing a rectangular insulated wire by subjecting round insulated wire to one roll pass, but also for production using more than one roll pass. For example, the invention is particularly effective in producing rectangular insulated wire having a width to thickness ratio of five or more by subjecting round insulated wire to more than one roll pass.

The insulating coating used in the present invention is typically required to endure a heat treatment intended for softening the conductor. For this purpose, an insulating coating capable of resisting temperatures of 200° C. or higher may be prepared from a single layer of polyimide, polyamideimide, polyesterimide, polyesteramideimide or polyhydantoin, or a composite layer made of a combination of these polymers. If the conductor of the finished rectangular insulated wire need not be softened, insulating coating made of less heat-resistant (<200° C.) polymers such as polyester, polyurethane, polyvinyl formal and epoxy resins may also be used.

The present invention will hereunder be described in greater detail with reference to working and comparative examples, to which the scope of the invention is by no means limited.

COMPARATIVE EXAMPLE 1

A copper conductor (0.6 mm$^{\phi}$) was coated with a polyamideimide film which was baked to provide an insulating coating of a thickness of 0.015 mm. The resulting round insulated wire was rolled into a rectangular cross section (0.22 mm×1.00 mm), which was then passed through a softening chamber (450° C.). The rectangular insulated wire thus obtained was wound around a mandrel (50 mm$^{\phi}$) edgewise 50 turns, and then checked for cracking in the insulating coating with a magnifying glass (50×). Thereafter, the wire was subjected to a uniformity test (JIS C 3003) to determine the number of defective points for a sample length of 30 m. The wire was also checked for the occurrence of separation of the insulating coating from the conductor. The results are shown in Table 1.

COMPARATIVE EXAMPLE 2

A copper conductor (0.66 mm$^{\phi}$) was passed through a tandem-drawing machine containing a single die (orifice diameter: 0.60 mm). The reduction ratio was 17.4%. Before entering the die, the conductor was supplied with fresh lubricating oil. The drawn wire was guided out of the drawing machine by a ceramic capstan and fed into an electrolytic cleaning zone where the wire was cleaned of excess metal particles and lubricating oil. The electrolyte was a 1% aqueous solution of $NaHCO_3$, and the voltage and current density were 30 volts and 5.5 mA/mm$^2$, respectively. Excess electrolyte was washed from the conductor with warm water and a polyamideimide coating was applied to the cleaned conductor and baked. The so-prepared round wire with an insulating coating 15 μm thick was rolled into a rectangular shape (0.22 mm×1.00 mm). The wire was passed through a softening chamber (450° C.). The rectangular insulated wire thus obtained was wound around a mandrel (50 mm$^{\phi}$) edgewise 50 turns, and then checked for cracks in the insulating coating with a magnifying glass (50×). Thereafter, the wire was subjected to a uniformity test (JIS C 3003), and the number of defective points that occurred for a sample length of 30 m was determined. The wire was also checked for the occurrence of separation of the insulating coating from the conductor. The results are shown in Table 1.

COMPARATIVE EXAMPLE 3

An aluminum conductor (0.5 mm$^{\phi}$) was coated with a polyimide film which was baked to provide an insulating coating of a thickness of 0.012 mm. The resulting round insulated wire was rolled into a rectangular cross section (0.21 mm×0.86 mm), and subsequently passed through a softening chamber (450° C.). The rectangular insulated wire thus obtained was wound around a mandrel (50 mm$^{\phi}$) edgewise 50 turns, and then checked for cracks in the insulating coating with a magnifying glass (50×). Thereafter, the wire was subjected to a uniformity test (JIS C 3003), and the number of defective points that occurred in a sample length of 30 m was counted. The wire was also checked for the occurrence of separation of the insulating coating from the conductor. The results are shown in Table 1.

COMPARATIVE EXAMPLE 4

An aluminum conductor (0.54 mm$^{\phi}$) was passed through a tandem-drawing machine containing a single die (orifice diameter: 0.50 mm). The reduction ratio was 14.3%. Before entering the die, the conductor was supplied with fresh lubricating oil. The drawn wire was guided out of the drawing machine by a stainless steel capstan thermal-spray coated with METCO 444 (product of Daiichi Metco Co. of Japan) and fed into an electrolytic cleaning bath where the wire was cleaned of excess metal particles and lubricating oil. The electrolyte was a 1% aqueous solution of $NaHCO_3$, and the voltage and current density were 30 volts and 5.5 mA/mm$^2$, respectively. Excess electrolyte was washed from the conductor with warm water, and a polyimide coating was applied to the cleaned conductor and baked. The so-prepared round wire with an insulating coating of a thickness of 12 μm was rolled into a rectangular cross section (0.21 mm×0.86 mm), and the resulting wire was passed through a softening chamber (450° C.). The rectangular insulated wire thus obtained was wound around a mandrel (50 mm$^{\phi}$) edgewise 50 turns, and then checked for cracks in the insulating coating with a magnifying glass (50×). Thereafter, the wire was subjected to a uniformity test (JIS C 3003), and the numer of defective points that occurred in a sample length of 30 m was counted. The wire was also checked for the occurrence of separation of the insulating coating from the conductor. The results are shown in Table 1.

COMPARATIVE EXAMPLE 5

A rectangular insulated aluminum wire with a polyimide insulating coating was prepared as in Comparative Example 4, except that the capstan for guiding the conductor out of the drawing machine was made of stainless steel with a hard chromium plating. The characteristics of the soprepared rectangular wire are shown in Table 1.

EXAMPLE 1

A rectangular insulated copper wire with a polyamideimide coating was prepared as in Comparative Example 2, except that a copper conductor (0.62 mmΦ) was drawn down at a reduction ratio of 6.3% and the capstan for guiding the conductor out of the drawing machine was made of polyvinyl chloride. The characteristics of the so-prepared rectangular wire are shown in Table 2.

EXAMPLE 2

A rectangular insulated copper wire with a polyamideimide coating was prepared as in Comparative Example 2, except that the capstan was made of steel with a urethane rubber lining. The characteristics of the so-prepared rectangular wire are shown in Table 2.

EXAMPLE 3

A rectangular insulated copper wire with a polyamideimide coating was prepared as in Comparative Example 2, except that the capstan was made of nylon 66. The characteristics of the so-prepared rectangular wire are shown in Table 2.

EXAMPLE 4

A rectangular insulated copper wire with a polyamideimide coating was prepared as in Comparative Example 2, except that the capstan was made of an epoxy resin. The characteristics of the so-prepared rectangular wire are shown in Table 2.

EXAMPLE 5

A rectangular insulated copper wire with a polyamideimide coating was prepared as in Comparative Example 2, except that the capstan was made of a melamine resin. The characteristics of the so-prepared rectangular wire are shown in Table 2.

EXAMPLE 6

A rectangular insulated copper wire with a polyamideimide coating was prepared as in Comparative Example 4, except that the capstan was made of polyvinyl chloride. The characteristics of the so-prepared rectangular wire are shown in Table 2.

EXAMPLE 7

A rectangular insulated copper wire with a polyamideimide coating was prepared as in Comparative Example 4, except that an aluminum conductor (0.55 mmΦ) was drawn down at a reduction ratio of 17.4%, and the capstan was made of an ABS resin. The characteristics of the so-prepared rectangular wire are shown in Table 2.

EXAMPLE 8

A rectangular insulated copper wire with a polyamideimide coating was prepared as in Comparative Example 4, except that an aluminum conductor (0.55 mmΦ) was drawn down at a reduction ratio of 17.4%, and the capstan was made of steel with a silicone rubber lining. The characteristics of the so-prepared rectangular wire are shown in Table 2.

EXAMPLE 9

A rectangular insulated copper wire with a polyamideimide coating was prepared as in Comparative Example 4, except that an aluminum conductor (0.55 mmΦ) was drawn down at a reduction ratio of 17.4%, and the capstan was made of polyacetal. The characteristics of the so-prepared rectangular wire are shown in Table 2.

In Comparative Examples 1 and 3, rectangular insulated wires were prepared by rolling and softening round insulated wires according to the prior art method. These wires had cracks in the insulating coating, which separated from the conductor. In the uniformity test, as many as 110 defective points were found in the respective wires. These results were in sharp contrast with those of Examples 1 to 9 wherein rectangular insulated wire fabricted according to the present invention had no cracks in the insulating coating and no separation thereof from the conductor was observed. Furthermore, the number of defective points found in the uniformity test was very small and ranged from only 3 to 12. In Comparative Examples 2, 4 and 5, rectangular wires were prepared generally according to the scheme of the present invention. However, owing to the use of capstans harder than the conductor, many microscopic flaws developed in the conductor surface, causing cracks in the insulating coating though no separation of the insulating coating from the conductor occurred. The number of defective points found in the uniformity test ranged from 90 to 100, and was by no means smaller than that of the defective points found in Comparative Examples 1 and 3.

TABLE 1

| | Comparative Example No. | | | | |
|---|---|---|---|---|---|
| | 1 | 2 | 3 | 4 | 5 |
| Conductor exposed due to cracking in insulating coating | yes | yes | yes | yes | yes |
| No. of defective points found in uniformity test (30 V a.c. in 3% aq. $Na_2SO_4$) | 100 | 100 | 90 | 95 | 90 |
| Separation of insulating coating from conductor | yes | no | yes | no | no |

TABLE 2

| | Example No. | | | | | | | | |
|---|---|---|---|---|---|---|---|---|---|
| | 1 | 2 | 3 | 4 | 5 | 6 | 7 | 8 | 9 |
| Conductor exposed due to cracking in insulating coating | no | no | no | no | no | no | no | no | no |
| No. of defective points found in uniformity test (30 V a.c. in 3% aq. $Na_2SO_4$) | 10 | 9 | 5 | 8 | 12 | 3 | 5 | 6 | 3 |
| Separation of insulating coating from conductor | no | no | no | no | no | no | no | no | no |

We claim:

1. A process for producing insulated rectangular wire, comprising the steps of:

drawing a round wire through a die in a tandem-drawing device;

electrolytically cleaning the drawn wire;

applying an insulating coating onto the cleaned surface;

baking the insulating coating;

subjecting the insulated wire to at least one cycle of rolling; and wherein said step of drawing said round wire comprises drawing down said round wire by means of a single die and a capstan to thereby remove any surface defects in said conductor having a size of 3 μm or greater, said capstan being made of a material softer than said conductor.

2. The process according to claim 1 further including the step of applying fresh lubricating oil containing no metal dust onto the surface of the conductor during said step of drawing.

3. The process according to claim 1, wherein said wire is made of a material selected from the group consisting of copper, alloys of copper, aluminum, and alloys of aluminum.

* * * * *